US010718512B2

(12) United States Patent
Dorval et al.

(10) Patent No.: US 10,718,512 B2
(45) Date of Patent: Jul. 21, 2020

(54) BURNER FOR GAS HEATED FURNACE AND METHOD OF OPERATION THEREOF

(71) Applicant: Métal 7 Inc., Sept-Îles (CA)

(72) Inventors: Éric Dorval, Sept-Îles (CA); Steve Beaudin, Sept-Îles (CA); Guy De Carufel, Laval (CA)

(73) Assignee: Metal 7 Inc. (CA)

( * ) Notice: Subject to any disclaimer, the term of this patent is extended or adjusted under 35 U.S.C. 154(b) by 0 days.

(21) Appl. No.: 16/091,341

(22) PCT Filed: Apr. 5, 2017

(86) PCT No.: PCT/CA2017/050413

§ 371 (c)(1),
(2) Date: Oct. 4, 2018

(87) PCT Pub. No.: WO2017/173537

PCT Pub. Date: Oct. 12, 2017

(65) Prior Publication Data

US 2019/0128514 A1 May 2, 2019

Related U.S. Application Data

(60) Provisional application No. 62/318,393, filed on Apr. 5, 2016.

(51) Int. Cl.
*F23D 11/10* (2006.01)
*F23N 1/02* (2006.01)
(Continued)

(52) U.S. Cl.
CPC ..... *F23D 11/106* (2013.01); *C22B 9/05* (2013.01); *F23D 11/10* (2013.01); *F23N 1/02* (2013.01); *F27B 21/02* (2013.01)

(58) Field of Classification Search
CPC ..... C22B 1/16; C22B 9/05; C21B 13/0046; C21B 13/0053; F27B 21/02; F23D 11/10; F23D 11/106; F23N 1/02
See application file for complete search history.

(56) References Cited

U.S. PATENT DOCUMENTS 1,920,769 A 8/1933 Stevenson, Jr.
2,395,276 A 2/1946 Jordan
(Continued)

FOREIGN PATENT DOCUMENTS

CA 2365615 A1 8/2001
EP 2299174 A1 3/2011
(Continued)

OTHER PUBLICATIONS

Waibel, Richard T.; Michael G. Claxton & Bernd Reese. "Burner Design." The John Zink Hamworthy Combustion Handbook: vol. 2—Design and Operations (Charles E. Baukal, Jr. editor). CRC Press. pp. 152-171. Apr. 2013.*
(Continued)

*Primary Examiner* — Tima M. McGuthry-Banks
(74) *Attorney, Agent, or Firm* — McDonnell Boehnen Hulbert & Berghoff LLP

(57) ABSTRACT

A method of operating a burner assembly is provided. The method generally includes transporting combustible fuel and atomization air through concentric fluid lines of the burner assembly; mixing the combustible fuel and the atomization air to atomize the combustible fuel; adjusting a flow of the combustible fuel and the atomization air to obtain atomized fuel with an air-to-fuel atomization ratio of less than 0.6; outputting the atomized fuel from a nozzle of the burner assembly; and igniting the atomized fuel to produce a flame. A burner assembly operable by the method, and a corresponding nozzle are also provided.

12 Claims, 13 Drawing Sheets

(51) Int. Cl.
*C22B 9/05* (2006.01)
*F27B 21/02* (2006.01)

(56) References Cited

U.S. PATENT DOCUMENTS

| | | | | |
|---|---|---|---|---|
| 2,840,148 | A | 6/1958 | Waldemar | |
| 3,254,846 | A | 6/1966 | Schreter et al. | |
| 3,519,386 | A * | 7/1970 | Fedock et al. | C22B 1/14 75/758 |
| 4,249,885 | A | 2/1981 | Reich | |
| 5,431,559 | A * | 7/1995 | Taylor | F23C 6/045 239/422 |
| 5,573,392 | A * | 11/1996 | Paikert | F23D 11/107 431/10 |
| 5,581,998 | A | 12/1996 | Craig | |
| 5,829,683 | A | 11/1998 | Beaudoin et al. | |
| 5,947,716 | A | 9/1999 | Bellamy | |
| 6,210,151 | B1 | 4/2001 | Joshi et al. | |
| 6,358,041 | B1 | 3/2002 | Whittaker et al. | |
| 7,530,351 | B2 | 5/2009 | Leverty | |
| 8,197,249 | B1 | 6/2012 | Nguyen | |
| 8,678,813 | B2 | 3/2014 | Gieshoff et al. | |
| 8,960,108 | B1 | 2/2015 | Lobik et al. | |
| 2007/0003897 | A1 * | 1/2007 | Koizumi | F23R 3/28 431/354 |
| 2009/0136882 | A1 | 5/2009 | Zalman | |

FOREIGN PATENT DOCUMENTS

| | | | | |
|---|---|---|---|---|
| GB | 163623 A | * | 5/1921 | C22B 1/10 |
| GB | 1425367 | * | 2/1976 | |

OTHER PUBLICATIONS

Astec Burner Group, Astec's Economical Aggregate Drying Burner, Operation and Service Manual, Version 1, p. 1-34, Dec. 16, 2014.
Pyronics, A Selas Heat Technology Brand, Burners Excess Air Single Tunnel "Cool Flame", Bulletin 3502, p. 1-7.
International Search Report issued for application No. PCT/CA2017/050413, dated Jul. 22, 2017, 3 sheets.
Written Opinion of the International Searching Authority issued for application No. PCT/CA2017/050413, dated Jul. 22, 2017, 5 sheets.
International Preliminary Report on Patentability issued for application No. PCT/CA2017/050413, dated Aug. 4, 2018, 25 pages.

* cited by examiner

BURNER FOR GAS HEATED FURNACE AND METHOD OF OPERATION THEREOF

This application is the US national phase under 35 U.S.C. § 371 of International Application No. PCT/CA2017/050413, filed Apr. 5, 2017, which claims priority to U.S. Provisional Patent Application No. 62/318,393, filed Apr. 5, 2016, which are incorporated herein by reference in their entirety.

TECHNICAL FIELD

The technical field generally relates to heating systems including burners. More particularly, it relates to an improved burner for heating iron ore agglomerated balls to high temperatures in order to induce diffusion bonding and produce iron ore pellets. It also relates to a method for heating an induration furnace in which agglomerated balls of iron-ore are indurated into fired pellets.

BACKGROUND

An important proportion of iron oxides for ironmaking are provided in a pellet shape. To manufacture the pellets, an iron ore concentrate is agglomerated on one or several balling devices and the agglomerated balls are fired in an induration furnace, such as a moving grate furnace or a grate kiln, to induce diffusion bonding, thereby increasing their mechanical properties for their handling and transportation to a reduction site.

In the induration furnace, the agglomerated balls are first dried in a drying zone to remove their water content. They can then be pre-heated in a pre-heating zone in order to gradually increase their temperature to avoid thermal shock. The agglomerated balls are then indured in a high temperature induration zone to create physical links between the particles and, consequently, increase their mechanical properties. Finally, the pellets are cooled in a cooling zone to obtain pellets at a temperature suitable for subsequent handling.

The drying and diffusion bonding processes occur mostly by heat transfer through forced convection, i.e. the air circulating in the drying and induration zones is heated and heat is transfer to the pellets. The induration of the agglomerated balls involves high energy consumption in the drying and induration zones. For instance, in the induration zone, the air circulating around the agglomerated balls can reach temperatures up to 1350° C.

Air heating is typically accomplished using heavy oil or natural gas burners.

Heavy oil burners used for this purpose generally use pressurized air (i.e. air with a pressure greater than atmospheric pressure) to force fuel through a nozzle and atomize it into a fine spray. The burner is inserted into the induration furnace where the spray is ignited into a flame which heats the air directly in the induration furnace. As can be appreciated, the burner is exposed to very high temperatures. Existing heavy oil burners are therefore provided with a cooling mechanism in order to prevent damage during operation and to control the flame. This cooling mechanism involves using low pressure air (i.e. air with pressure greater than atmospheric pressure, but less than that of the pressurized air used for atomization) to regulate the temperature of the burner and control the flame.

With reference to FIGS. 1A to 1C, an oil burner 1 of the prior art is shown. The burner 1 has a metal-based body 3 shaped as a "spear" which comprises an elongated portion 5 and a nozzle 7. The elongated portion 5 houses three concentric flow lines 9, 11, 13 for transmitting fluid to the nozzle 7. In the center is a fuel line 9 for carrying heavy oil fuel 9*a* in liquid form to the nozzle 7. Around the fuel line 9 is an atomization gas line 11 which carries air at high pressure 11*a* to the nozzle 7. Finally, around the atomization gas line 11 is a cooling air line 13 which carries air at low pressure 13*a* to help cool the spear and control the flame at a nozzle outlet 15.

As can be appreciated, the fuel 9*a* and atomization air 11*a* are mixed inside the nozzle 7 to form an atomized fuel mixture 15*a* at the outlet 15 of the nozzle 7. Meanwhile, the cooling air line 13 cools the spear by circulating air 13*a* along outer sidewalls 17 of the spear body 3. The air is blown at low pressure along the outer sidewalls 17 before eventually exiting around the nozzle 7. Blowing the air 13*a* in this fashion also allows controlling the flame at the outlet 15.

Although the cooling air 13*a* helps regulate the temperature of the burner 1 and keep it at a nominal temperature during continuous operation, the air 13*a* exiting the nozzle 7 causes additional cold air to enter into the induration air. This additional air must also be heated, and heating this additional air requires additional oil consumption which can be considered as being a loss of energy.

SUMMARY

An object of the present disclosure is to provide a burner which reduces inefficiencies in burners of the prior art. More particularly, a burner capable of operating continuously with reduced cooling air or without cooling air is provided, along with a method of operation thereof for use in the process of iron ore induration. It is appreciated that operating with reduced cooling air does not have an effect on the quality of combustion, as the air contained in the furnace chamber(s) is used for combustion.

According to an aspect, a heavy oil burner is provided for use in a gas-heated furnace such as an induration furnace. The burner includes a body having an elongated section in fluid communication with a nozzle. The elongated section includes a fuel line connectable to a fuel supply and a primary atomization line connectable to a pressurized air supply. The fuel and primary atomization lines are in fluid communication with the nozzle for providing fuel and pressurized air thereto. The nozzle includes a plurality of channels for combining the fuel with the pressurized air in order to form an atomized fuel mixture, and output the atomized fuel mixture from a plurality of corresponding apertures arranged peripherally around an outer edge thereof at an angle of approximately 2 to 10 degrees. In an embodiment, the size of the channels is selected to attain a total air-to-fuel atomization ratio of less than approximately 0.25.

According to an aspect, a nozzle assembly for a heavy oil burner is provided, the nozzle assembly having an atomization air inlet, a fuel inlet, and an outlet. The nozzle assembly mixes atomization air and fuel supplied from their respective inlets to produce atomized fuel at the outlet. In an embodiment, the nozzle assembly directs atomization air along a substantially longitudinally extending path as it travels from the atomization air inlet to the outlet, and directs fuel in a longitudinally and outwardly extending path to intersect with the longitudinally extending path of the atomization air before exiting through the outlet. In an embodiment, the paths of the atomization air and fuel intersect at the outlet. In an embodiment, the outlet is aligned with a front face of the nozzle assembly. In an embodiment, the nozzle assembly includes a plurality of atomization channels dividing the atomization air into a plurality of streams, each stream being mixed with fuel to be output as a plurality of atomized fuel streams. In an embodiment, the nozzle assembly includes an atomization air nozzle having a body with a cavity defined by an inner surface, and a fuel nozzle having a body with an outer surface, the fuel nozzle being engageable in the cavity of the atomization air nozzle. The body of the fuel nozzle includes a fuel line interface, a plurality of fuel channels extending outwardly from the fuel line interface for carrying fuel to the outer surface, and a plurality of grooves provided along the outer surface. The grooves in the outer surface define, together with the inner surface of the atomization nozzle, atomization channels which intersect with the fuel channels along the outer surface and open as a plurality of corresponding outlets on a front face of the nozzle assembly. In an embodiment, the outlets are arranged peripherally around a front face of the nozzle, and are angled at approximately 2 to 10 degrees away from a central axis of the nozzle assembly.

According to an aspect, a method for operating a heavy oil burner is provided. The method involves operating the heavy oil burner without the use of cooling air by providing a flow of atomization air, providing a flow of fuel, mixing the flow of atomization air with the flow of fuel to create a flow of atomized fuel, and igniting the atomized fuel to form a flame. In an embodiment, the atomization air flows along a substantially longitudinally extending path as it travels through the burner and out through its outlet. In an embodiment, the flow of fuel is directed outwardly to intersect and mix with the atomization air. In an embodiment, flow of atomization air and flow of fuel intersect proximate to the outlet. In an embodiment, the atomization air, fuel, or both are divided into a plurality of streams. In an embodiment, a ratio of the flow of atomization air to the flow of fuel is less than 0.25. In an embodiment, the flow of atomized fuel is outputted from a burner nozzle as a plurality of peripherally arranged streams. In an embodiment, each of the peripherally arranged streams is angled at approximately 5 degrees away from a central axis of the burner nozzle.

According to an aspect, a method for heating agglomerated balls in an iron-ore induration furnace is provided. The method involves using the above-described burner and method to heat the agglomerated balls of iron-ore in an induration furnace.

According to an aspect, a method of operating a burner assembly having an elongated body extending along a central axis between an input end and an output end is provided. The method includes the steps of: a) providing combustible fuel at the input end of the burner assembly; b) providing atomization air at the input end of the burner assembly; c) transporting the combustible fuel and the atomization air to the output end of the burner assembly through concentric fluid lines; d) mixing the combustible fuel and the atomization air to atomize the combustible fuel; e) adjusting a flow of the combustible fuel and the atomization air to obtain atomized fuel with an air-to-fuel mass ratio of less than 0.6; f) outputting the atomized fuel from a nozzle at the output end of the burner assembly; and g) igniting the atomized fuel to produce a flame.

In an embodiment, the method includes the steps of providing secondary air at the input end of the burner assembly, transporting the secondary air to the output end of the burner assembly in a secondary air line concentric with the combustion fuel and atomization air lines, outputting the secondary air from the nozzle to control the flame, and adjusting a flow of the secondary air to obtain a ratio of atomization air mass to secondary air mass of 0.5 or greater.

In an embodiment, the method includes the step of adjusting the flow of the secondary air to achieve a secondary air output from the nozzle at a rate of less than 100 kg/h.

In an embodiment, the method includes the step of outputting the secondary air from the nozzle in a plurality of streams positioned around the flame.

In an embodiment, the secondary air is provided at a consistent flow rate throughout the operation of the burner assembly, to cool the burner assembly and maintain it at a safe temperature.

In an embodiment, the method includes measuring a temperature of the burner assembly, and varying the flow rate of the secondary air to cool the burner assembly and maintain it at a safe temperature.

In an embodiment, the burner assembly is operated without secondary cooling air.

In an embodiment, the method includes the step of outputting the atomized fuel from the nozzle in a plurality of streams positioned around the central axis of the burner assembly.

In an embodiment, the method includes the step of outputting the atomized fuel from the nozzle at an angle between 2 and 20 degrees relative to the central axis of the burner assembly.

In an embodiment, the method includes the step of outputting the atomized fuel from the nozzle at an angle of approximately 5 degrees relative to the central axis of the burner assembly.

In an embodiment, mixing the combustible fuel and the atomization air includes the steps of dividing the combustible fuel into a plurality of streams, dividing the atomization air into a plurality of streams, and mixing each stream of atomization air with a respective stream of combustible fuel to produce a plurality of streams of atomized fuel.

In an embodiment, the method includes the step of directing the plurality of combustible fuel streams peripherally outward to intersect with the plurality of atomization air streams, the plurality of atomization air streams extending substantially parallel relative to the central axis of the burner assembly.

In an embodiment, the combustible fuel is heavy oil.

According to an aspect, a method of heating metal-based material in an induration furnace is provided. The method includes the steps of providing a burner assembly, inserting the nozzle of the burner assembly into a chamber of the induration furnace, and operating the burner assembly according to the method described above to produce a flame in the induration furnace to heat the metals.

According to an aspect, a burner assembly is provided. The burner assembly includes an elongated body extending along a central axis between an input end and an output end; a fuel input at the input end for receiving combustible fuel; an atomization air input at the input end for receiving atomization air; a fuel line in fluid communication with the fuel input, the fuel line extending centrally through the elongated body for transporting the combustible fuel to the output end; an atomization air line in fluid communication with the atomization air input, the atomization air line extending through the elongated body, around the fuel line and concentric therewith, for transporting the atomization air to the output end; and a nozzle provided at the output end in fluid communication with the fuel line and the atomization air line, the nozzle being configured to mix the combustible fuel and the atomization air to produce atomized fuel, and to output the atomized fuel at an angle between 2 and 20 degrees relative to the central axis.

In an embodiment, the nozzle is configured to output the atomized fuel at an angle of approximately 5 degrees.

In an embodiment, the burner assembly includes an outermost tube extending around, and concentric with, the fuel and atomization air lines, the outermost tube having a peripheral wall spaced-apart from the atomization air line, defining an insulating space therebetween.

In an embodiment, the peripheral wall of the outermost tube has a thickness between about 1.5 mm and 5 mm.

In an embodiment, the peripheral wall of the outermost tube has a thickness of approximately 3.9 mm.

In an embodiment, the burner assembly includes a secondary air input at the input end for receiving secondary air, and the outermost tube defines a secondary air line in fluid communication with the secondary air input for transporting the secondary air to the output end.

In an embodiment, the nozzle is in fluid communication with the secondary air line and is configured to output the secondary in a space surrounding the atomized fuel.

In an embodiment, the nozzle includes a plurality of secondary air conduits in fluid communication with the secondary air line for dividing the secondary air into a plurality of streams.

In an embodiment, the nozzle includes a plurality of atomization air conduits for dividing the atomization air into a plurality of streams, and a plurality of fuel conduits for dividing the fuel into a plurality of streams, the atomization air conduits intersecting with the fuel conduits proximate to a front face of the nozzle for mixing the atomization air and fuel and outputting a plurality of streams of atomized fuel.

According to an aspect, a nozzle assembly for a burner including concentric fuel, atomization air, and secondary air lines is provided. The nozzle assembly includes: a body having an interface end for interfacing with the burner, and an output end with a face for outputting atomized fuel; a plurality of atomization air conduits for fluid communication with the atomization air line of the burner to divide the atomization air into a plurality of streams; a plurality of fuel conduits for fluid communication with the fuel line of the burner to divide the fuel into a plurality of streams, the fuel conduits being angled peripherally outward and intersecting with the atomization air conduits for mixing the fuel and atomization air to form a plurality of streams of atomized fuel; and a plurality of primary apertures on the output end of the nozzle assembly body for outputting the atomized fuel, the primary apertures being positioned on the front face of the nozzle assembly body in a circular arrangement.

In an embodiment, the nozzle assembly includes a plurality of secondary air conduits for fluid communication with the secondary air line to divide the secondary air into a plurality of streams, the secondary air conduits opening on the front face of the nozzle body, and provided in a circular arrangement peripherally around the circular arrangement of the primary apertures.

In an embodiment, each of the plurality of fuel conduits are angled peripherally outward at an angle between 15 and 20 degrees relative to a central axis of the nozzle assembly.

In an embodiment, each of the fuel conduits has a diameter of between about 1.9 mm and about 25.4 mm.

In an embodiment, each of the primary apertures include an angled portion for directing atomized fuel exiting the nozzle assembly outwardly away from a central axis of the nozzle assembly.

In an embodiment, the angled portions are angled at approximately 2 to 20 degrees relative to the central axis of the nozzle assembly.

In an embodiment, each of the atomization air conduits has a diameter of approximately 1.3 mm and 3.2 mm.

DETAILED DESCRIPTION

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features illustrated in other figures can be easily inferred therefrom. The embodiments, geometrical configurations, materials mentioned and/or dimensions shown in the figures are optional, and are provided for exemplification purposes only.

In addition, although some of the embodiments as illustrated in the accompanying drawings comprises various components and although some of the embodiments of the burner as shown consists of certain geometrical configurations as explained and illustrated herein, not all of these components and geometries are essential and thus should not be taken in their restrictive sense, i.e. should not be taken as to limit the scope of the present invention. It is to be understood that other suitable components and cooperations thereinbetween, as well as other suitable geometrical configurations may be used for the burner and corresponding parts, according to the present invention, as briefly explained herein, without departing from the scope of the invention.

Figure 1A:
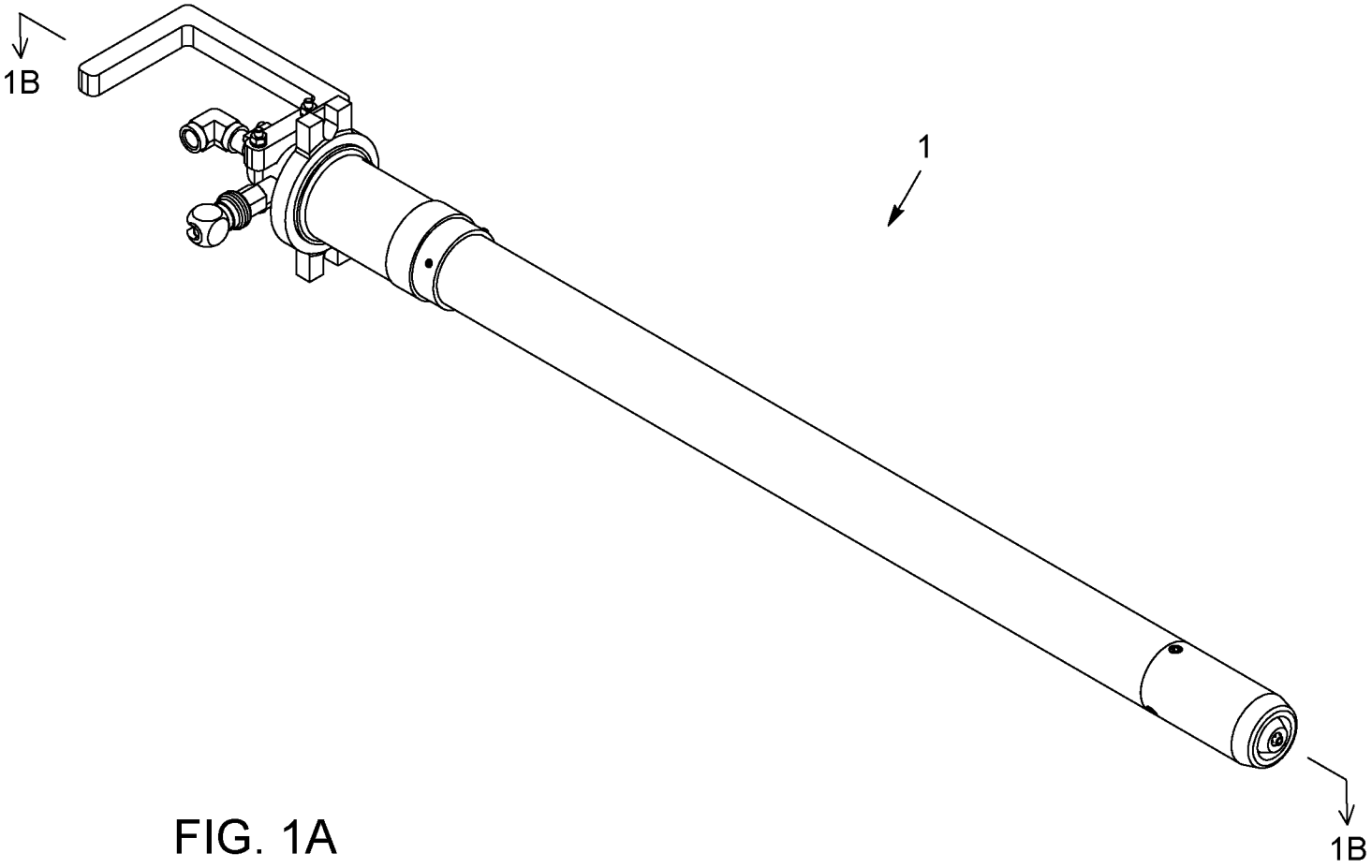
FIG. 1A (PRIOR ART)
FIG. 1A is a perspective view of a prior art oil burner, according to an embodiment.
Figure 1B:
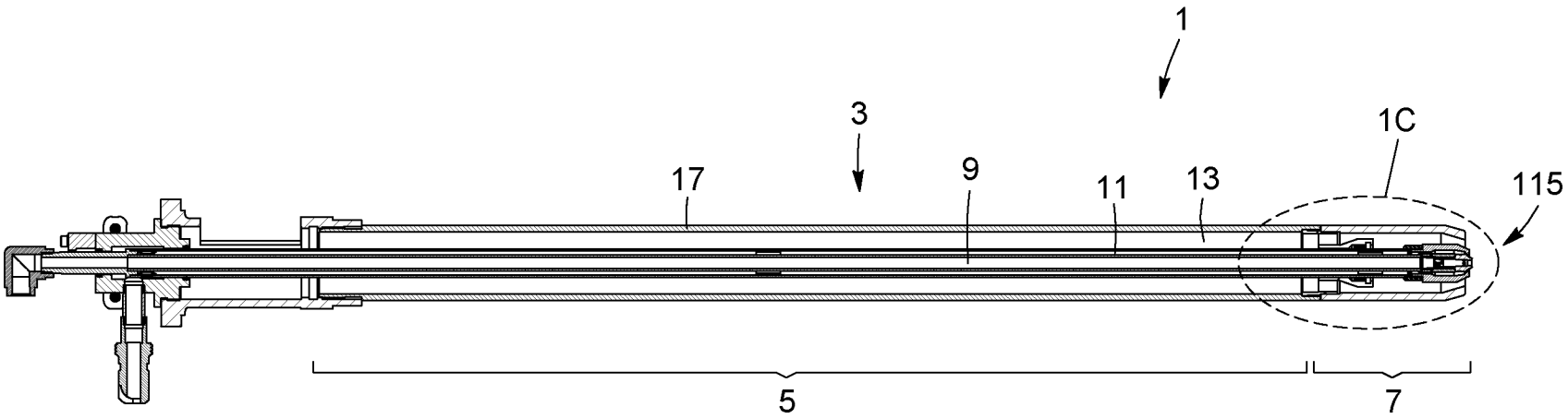
FIG. 1B (PRIOR ART)
FIG. 1B is a side cross-sectional view of the oil burner of FIG. 1A.
Figure 1C:
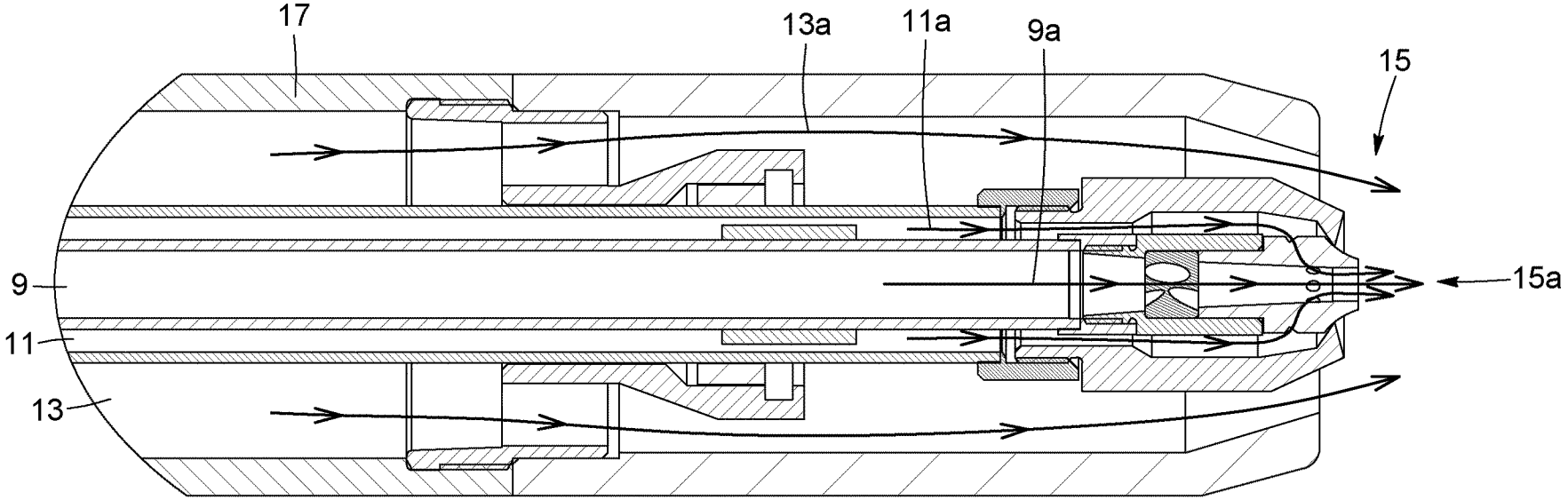
FIG. 1C (PRIOR ART)
FIG. 1C is a detail view of FIG. 1B showing the nozzle of the oil burner.
Figure 2A:
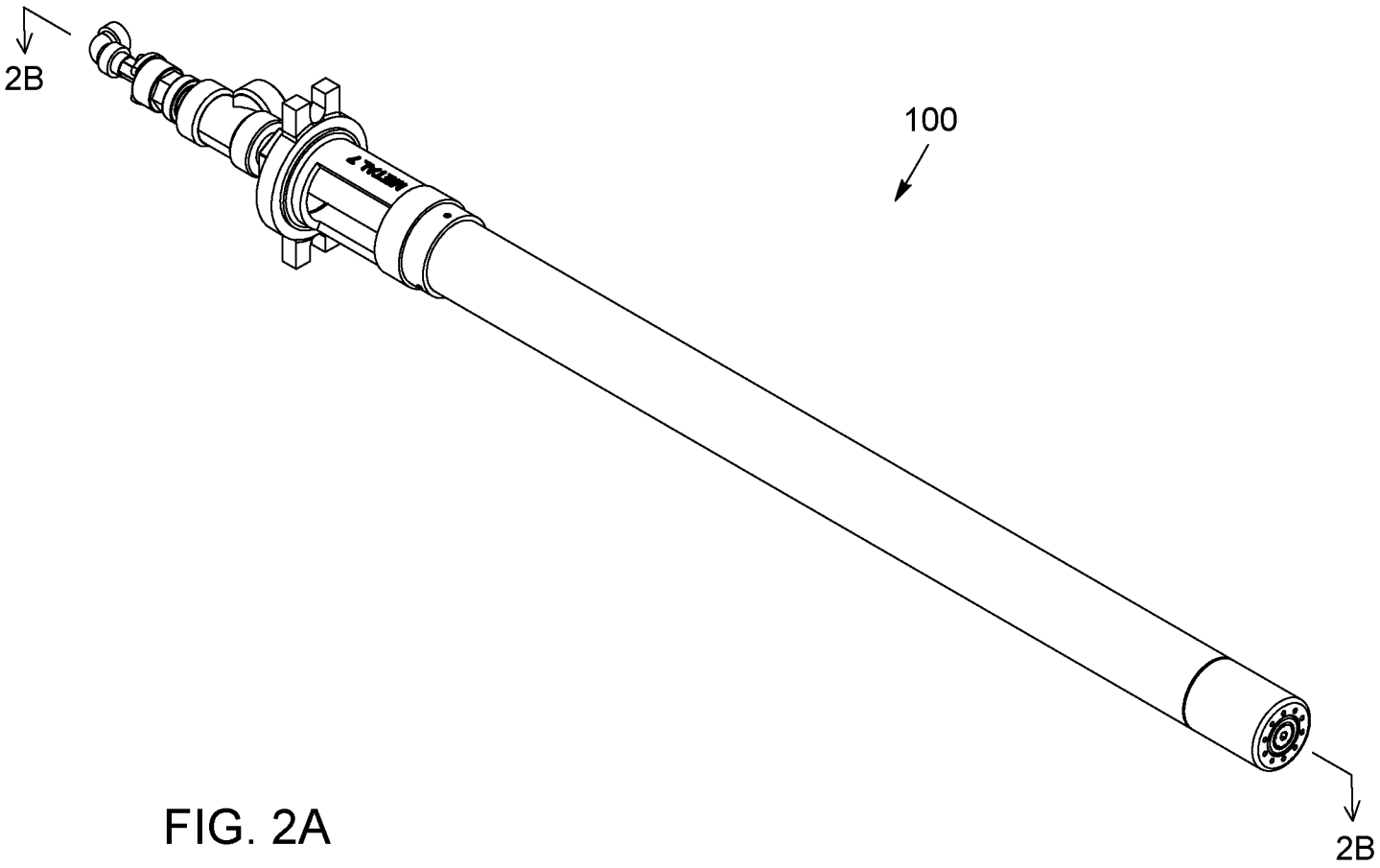
FIG. 2A is a perspective view of a heavy oil burner, according to a possible embodiment.
Figure 2B:
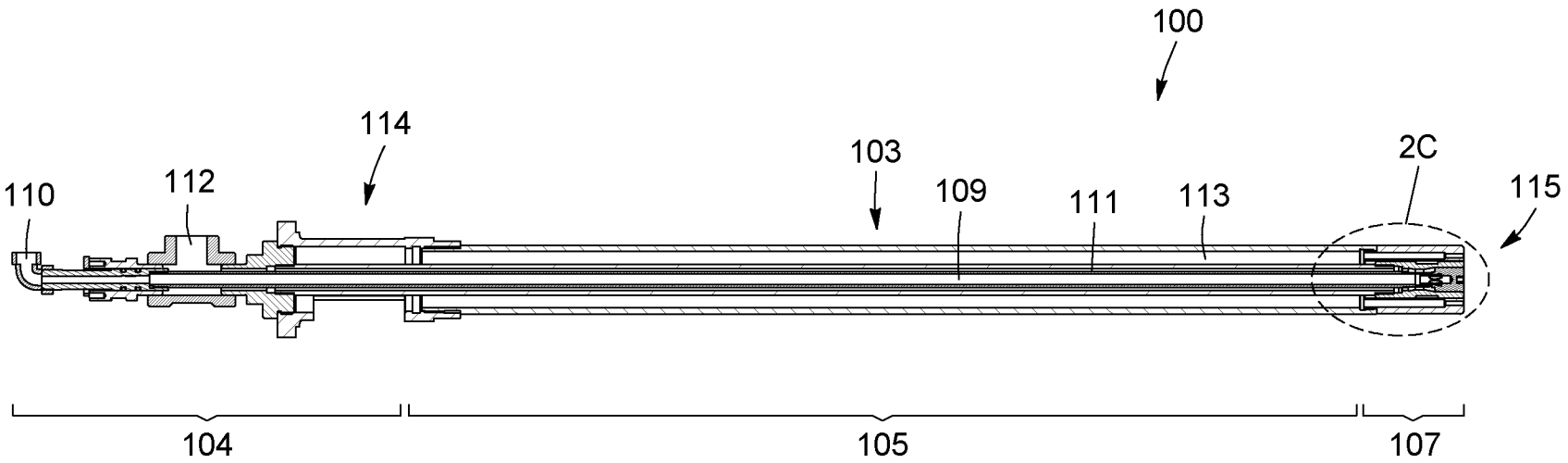
FIG. 2B is a side cross-sectional view of the oil burner of FIG. 2A.
Figure 2C:
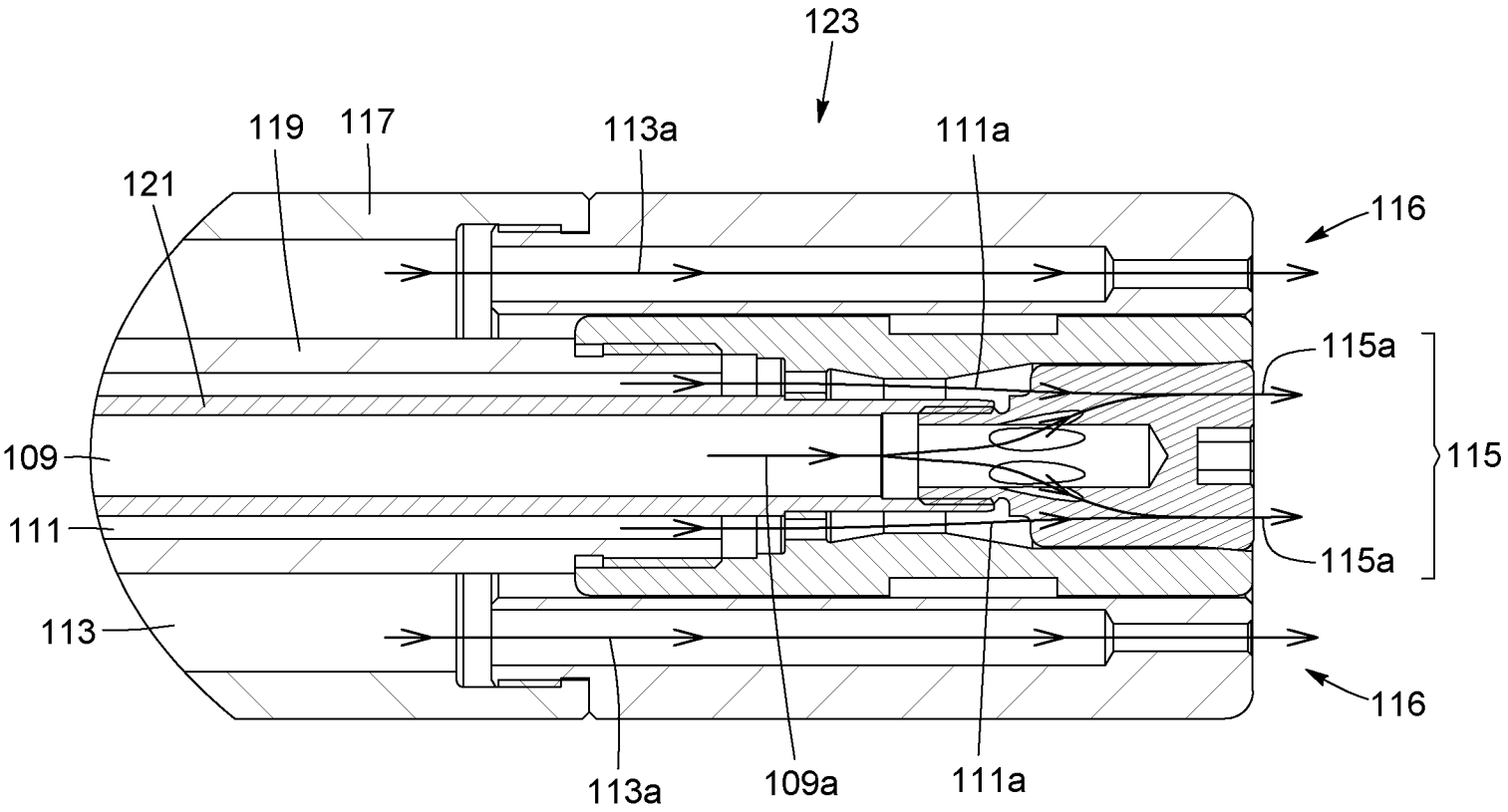
FIG. 2C is a detail view of FIG. 2B showing the output section of the oil burner.
Figure 3A:
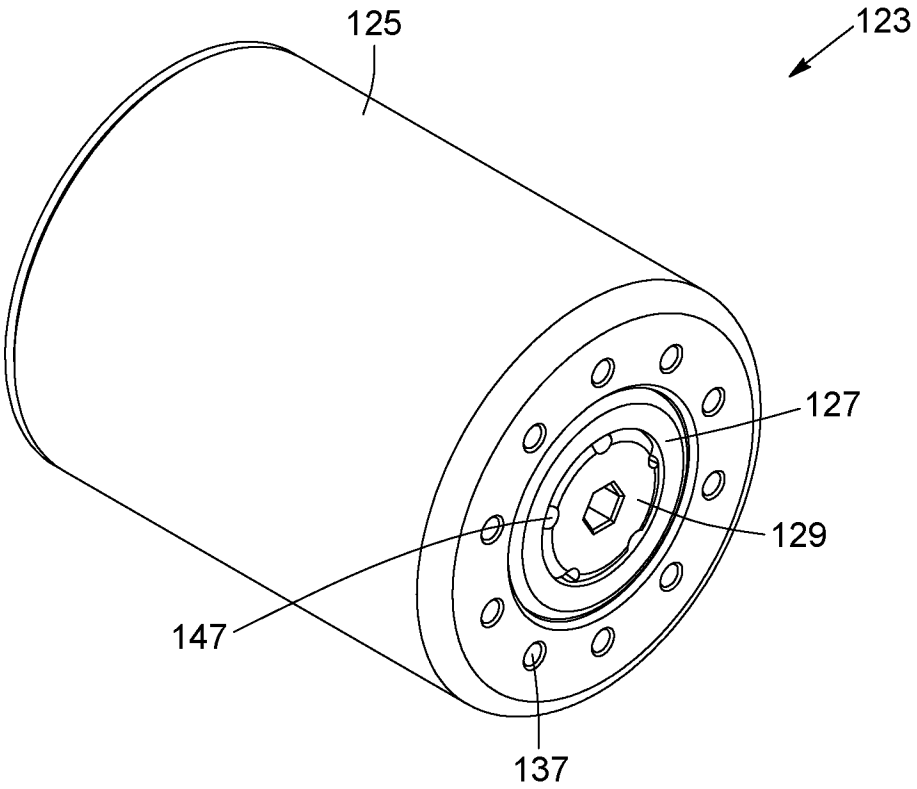
FIG. 3A is an isolated perspective view of a nozzle assembly in the oil burner of FIG. 2A.
Figure 3B:
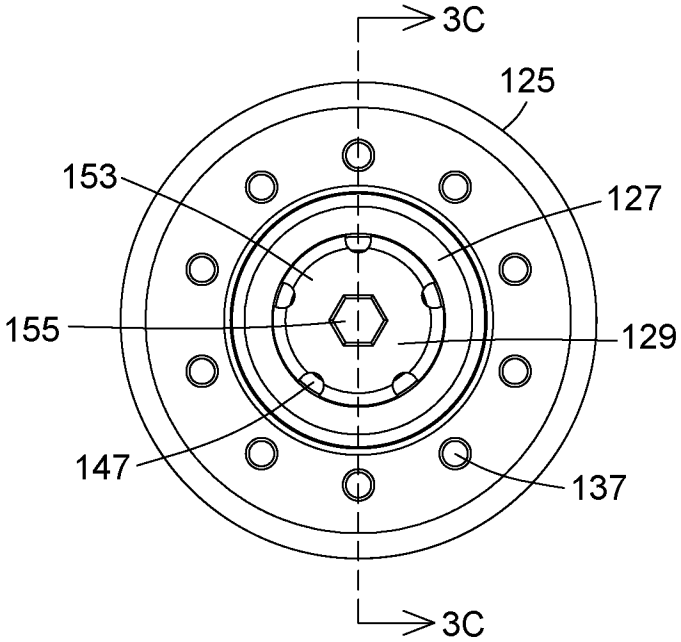
FIG. 3B is a front view of the nozzle assembly of FIG. 3A.
Figure 3C:
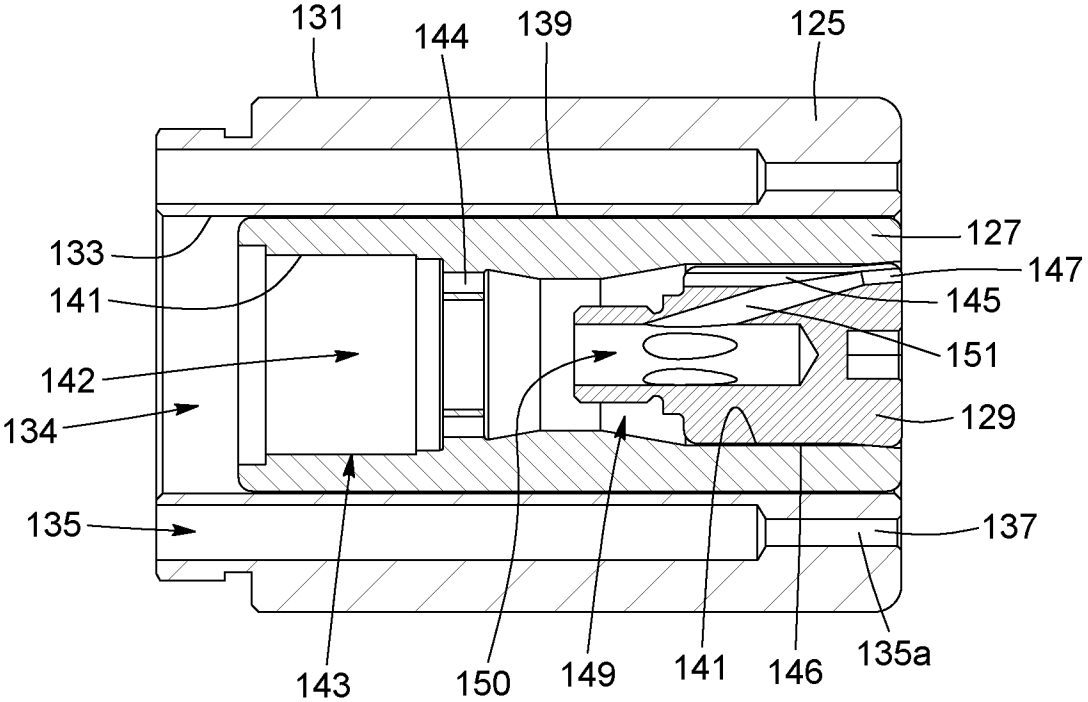
FIG. 3C is a cross-sectional view of the nozzle assembly taken along line 3C-3C of FIG. 3B.
Figure 3D:
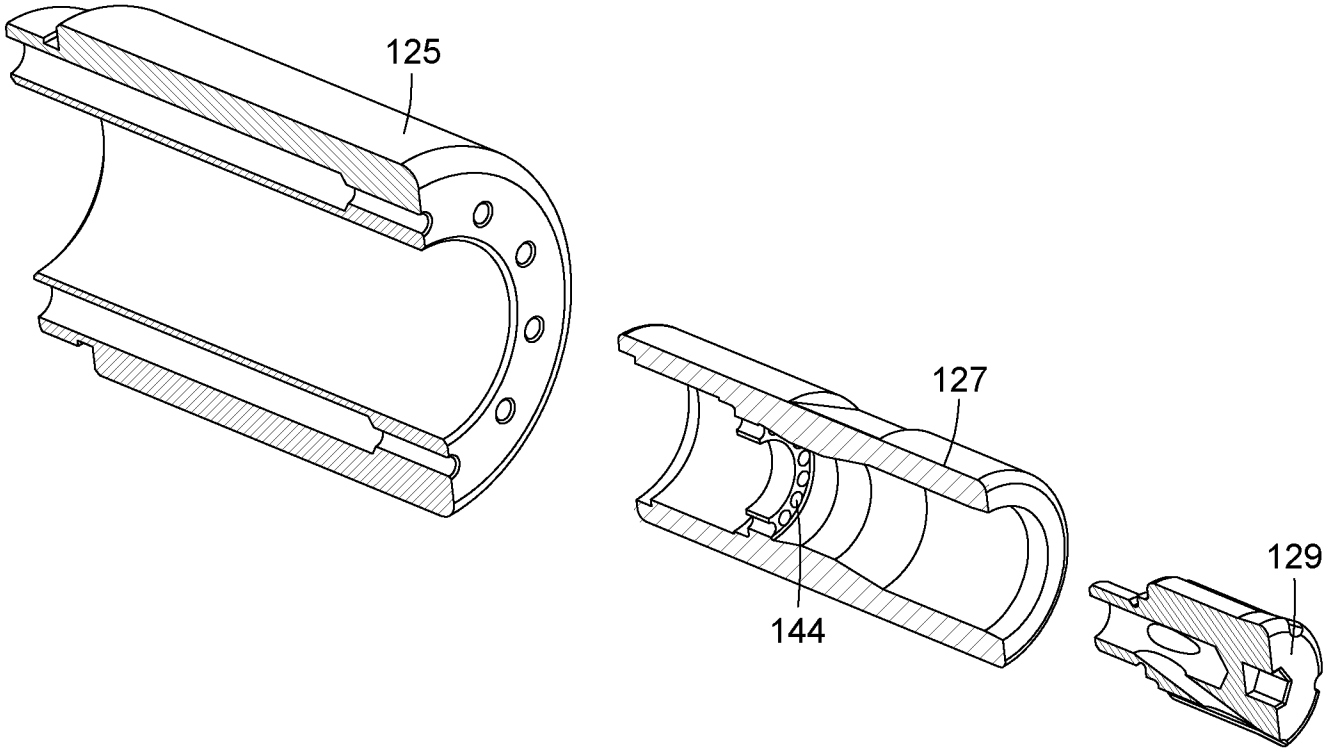
FIG. 3D is an exploded cross-sectional view of the nozzle assembly of FIG. 3A.

With reference to FIGS. 2A to 2C, an oil burner 100 is shown according to an embodiment. The burner 100 comprises a lanced-shaped metal-based body 103. As can be appreciated, this shape can allow the burner to be inserted into a corresponding narrow opening defined in a wall of an induration furnace for heating air therein. In the present embodiment, the body 103 comprises an input section 104 for receiving fluids, an elongated section 105 for transporting the fluids, and an output section 107 for outputting the fluids in a fashion suitable for ignition. The input section 104, the elongated section 105, and the output section 107 are configured in an adjacent and consecutive configuration and are in fluid communication with one another as will be described in more detail below.

The input section 104 is configured to connect to fluid supplies (not shown) to receive fluids required to operate the burner 100. In the present embodiment, the fluid supplies include an oil supply in fluid communication with an oil input 110 and a pressurized air supply in fluid communication with a pressurized air input 112. In an embodiment, the input section 104 is detachably connectable to the fluid supplies, for example with detachable couplings and/or fasteners (not shown).

The elongated section 105 is configured to act as a conduit for transporting fluids from the input section 104 to the output section 107. In the illustrated embodiment, the elongated section 105 comprises three concentric tubes 117, 119, 121, each having a peripheral wall respectively defining inner fluid lines 109, 111, 113. Innermost tube 121 defines a central fuel line 109 for transporting fuel, such as heavy oil 109*a* from the oil input 110 to the output section 107. Central tube 119 extends around the innermost tube 121, defining an annular primary atomization line 111 between the peripheral wall of innermost tube 121 and the peripheral wall of the central tube 119. The primary atomization line 111 serves to transport atomization fluid, such as pressurized air 111*a* from the pressurized air input 112 to the output section 107. Finally, outermost tube 117 extends around the central tube 119 defining an annular secondary air line 113 between the peripheral wall of the central tube 119 and the peripheral wall of the outermost tube 117. The secondary air line 113 defines an insulating space around the central tube 119, preferably containing air and thermally insulating central tube 119. Secondary air line 113 can optionally serve to transport secondary fluid, such as air 113*a*, and preferably air 113*a* at a lower pressure than the atomization air, from the input section 104 to the output section 107. This secondary air 113*a* can be used, for example, to better control the flame or to further cool the burner. It is appreciated, however, that in some embodiments, the outermost tube 117 need not be provided, for example to reduce the surface area of the burner body susceptible to absorbing temperature.

In some implementations, the tubes 117, 119, 121 are made of metal or other suitable material capable of resisting high temperatures, such as up to 1350° C. or more, and are resistant to corrosion. For example, at least the outermost tube 117 and the central tube 119 can be made of stainless steel such as AISI 310, Sandvik 253MA (an austenitic chromium-nickel steel alloyed with nitrogen and rare earth metals), Sandvik 353MA (an austenitic chromium-nickel steel alloyed with nitrogen and rare earth metals), Sandvik 31HT (an austenitic nickel-iron-chromium stainless steel alloy), Kanthal APMT (ferritic iron-chromium-aluminium alloy (FeCrAlMo alloy)) or the like.

As can be appreciated, the illustrated configuration of the elongated section 105 allows the burner 100 to withstand high temperatures, for example when inside or proximate to a gas-heated furnace. During operation, the peripheral wall of outermost tubes 117 is subject to high temperatures. The secondary air line 113 defines an insulating space which distances inner fluid lines 109, 111 from the peripheral wall of the outermost tube 117, thereby thermally insulating the fluid lines 109, 111 from the high temperatures. To allow the burner 100 to further withstand high temperatures, inner fluid lines 109, 111 can be further insulated and/or provided with a stronger structure, for example by thickening the peripheral wall of the central tube 119. For example, to better withstand temperatures of up to 1350° C. or more, the peripheral wall of the central tube 119 can have a thickness between about 1.5 mm (0.06 inches) and 5 mm (0.20 inches), and preferably about 3.9 mm (0.154 inches). As can be appreciated, this configuration of the elongated section 105 can provide sufficient insulation such that atomization fluid 111*a* and/or fuel 109*a* travelling through fluid lines 109, 111 can sufficiently regulate the temperature of the burner 100 during normal operation without the need of an additional cooling mechanism, such as low-pressure cooling air of the prior art.

During normal operation, the burner 100 can be operated without secondary fluid 113*a*. However, it is appreciated that the illustrated configuration can allow for the use of secondary air 113*a* when required, for example to temporarily provide additional cooling when the burner 100 reaches a certain temperature to prevent damage to the burner 100. In some embodiments, a reduced amount of secondary air 113*a* can be provided continuously to help maintain the burner 100 at lower temperatures during normal operation for security reasons. The input section 104 can include a secondary air input 114 in fluid communication with the secondary air line 113. The secondary air input 114 can provide pressurized air 113*a* to the secondary air line 113. In this fashion, pressurized air 113*a* is transported along the inner side of the peripheral wall of the outermost tube 117, and can thus serve to further cool and regulate the temperature of the burner 100.

The output section 107 is configured to output fluid transferred along the elongated section 105 in a controlled fashion which is suitable for ignition. The output section 107 includes a nozzle assembly 123 interfacing with the elongated section 105, at an end thereof, and in fluid communication with the fluid lines 109, 111, 113. During operation, the nozzle assembly 123 mixes fuel 109*a* and primary atomization fluid 111*a*, and outputs them through a primary outlet 115 as an atomized fluid mixture 115*a*. In some operating conditions, the nozzle assembly 123 can further output secondary air 113*a* through a secondary outlet 116, circumscribing the primary outlet 115, to better direct the fluid mixture 115*a* at the outlet and/or to further mix the atomized fluid mixture 115*a* with the secondary air 113*a* to achieve a desired fuel to fluid ratio. In some operating conditions, the nozzle assembly 123 can output secondary air 113*a* alone.

In the illustrated configuration, the primary outlet 115 outputs a plurality of streams of fluid mixture 115*a* from the nozzle assembly 123. The stream of heavy oil 109*a* in the central fuel line 109 is divided into a plurality of streams, while the stream of pressurized air 111*a* in the atomization line 111 is also divided into a plurality of streams. Each stream of heavy oil 109*a* is combined with a respective stream of pressurized air 111*a* in a predetermined ratio to create a corresponding stream of fuel mixture 115*a*. As can be appreciated, in this configuration, the fuel mixture 115*a* is outputted as several distinct streams, making it easier to control and direct than a single large stream.

With reference now to FIGS. 3A to 3D, the nozzle assembly 123 comprises a fuel nozzle 129, a primary atomization fluid nozzle 127 (or primary nozzle), and optionally a secondary air nozzle 125 (or secondary nozzle). In the present embodiment, each of these nozzles 125, 127, 129 are configured to engage with one another to form a nozzle assembly 123. The fuel nozzle 129 is substantially solid and fits within a corresponding cavity in the substantially hollow primary nozzle 127, while the primary nozzle 127 fits within a corresponding cavity in the substantially hollow secondary nozzle 125. Thus, when engaged together, the nozzles 125, 127, 129 are concentrically mounted. In this configuration, the atomized fuel can be outputted from a central region of the nozzle assembly 123. Similarly, the optional secondary air can be outputted in a region peripherally surrounding the atomized fuel for better control thereof. It is appreciated that, while the nozzles 125, 127, 129 are arranged in this fashion in the present embodiment, other arrangements are also possible, for example with different order of nozzles. Moreover, while in the illustrated embodiment the nozzles 125, 127, 129 fit within one another, it is appreciated that other configurations of the nozzles are also possible, and may form part of a single unit.

In the illustrated embodiment, the secondary nozzle 125 comprises a substantially hollow body having a wall with an outer surface 131 and an inner surface 133. The inner surface 133 defines a cavity 134 for receiving and securing the primary nozzle 127, preferably forming a tight connection therewith such that secondary air does not leak therebetween. Preferably still, the outer surface 131 is sized and shaped to tightly engage within the outermost tube 117 of the elongated section 105 of the burner 100, as shown in FIG. 2C. However, it is appreciated that in some embodiments, the secondary nozzle 125 could engage the outermost tube 117 by abutting an end thereof, or by fitting around the outermost tube 117.

A peripheral wall of the secondary nozzle 125 comprises a plurality of spaced-apart secondary air conduits 135 extending along its length, and opening at corresponding secondary apertures 137. As can be appreciated, when the secondary nozzle 125 is engaged with the outermost tube 117 of the elongated section 105 of the burner 100, secondary air provided therefrom is directed through the conduits 135 before eventually exiting the nozzle assembly 123 through the secondary apertures 137. In the present embodiment, a plurality of conduits 135 and corresponding apertures 137 are provided, the apertures 137 being evenly spaced along a front face of the secondary nozzle 125 along a circular path. In this configuration, the secondary air can be divided into a plurality of streams and outputted uniformly and evenly along a periphery of the nozzle assembly 123. In the present embodiment, the secondary air conduits 135 comprise a forward section 135*a* with reduced diameter. The forward section 135*a* can serve, for example, to reduce the output flow rate of the secondary air and/or to increase a pressure of the secondary air streams at the output to better control the flame. It is appreciated, however, that other configurations of the secondary apertures 137 are also possible in other embodiments. For example, more or fewer secondary apertures can be provided, and/or the apertures can be arranged in different configurations. Moreover, it is understood that although reference is made to multiple secondary conduits and apertures, this configuration can vary. For example, in some embodiments, a single secondary air conduit can open as a plurality of apertures. In other embodiments, a single secondary air conduit can open as a single aperture, such as a ring-shaped aperture extending around, and concentric with, primary apertures 147. In further embodiments, secondary conduits and/or secondary apertures need not be provided.

The primary nozzle 127 comprises a substantially hollow body having a wall with an outer surface 139 and an inner surface 141. The inner surface 141 defines a cavity 142 for receiving and securing the fuel nozzle 129, preferably forming a tight connection therewith. The inner surface 141 further defines a central tube interface 143 for interfacing and fluidly communicating with the central tube 119 of the elongated section 105 of the burner 100. The interface 143 is a region in which the primary nozzle 127 and the central tube 119 interact and fluidly connect. In the present embodiment, the interface 143 comprises the cavity 142 in the primary nozzle 127 for receiving and engaging the central tube 119. However, in other embodiments, the interface 143 can have a different configuration. For example, the interface 143 can comprise a portion of the primary nozzle 127 which fits inside the central tube 119. Preferably, the tube interface 143 forms a tight connection with the central tube 119 such that the primary atomization fluid does not leak therebetween, and such that the primary atomization fluid is directed towards the nozzle outlet 115. In the present embodiment, the primary nozzle 127 is further provided with a plurality of channels 144 positioned adjacent the central tube interface 143 and arranged peripherally there around. In this configuration, the primary atomization fluid provided by the central tube 119 can be distributed and evenly directed as it travels towards the nozzle outlet 115.

The fuel nozzle 129 comprises a substantially solid body with a front face 153 and an outer surface 146, and is sized to fit within the cavity of the primary nozzle 127. The fuel nozzle 129 includes an inner tube interface 149 for interfacing and fluidly communicating with the innermost tube 121 of the elongated section 105 of the body. The interface 149 is a region in which the fuel nozzle 129 and the inner tube 121 interact and fluidly connect. In the present embodiment, the interface 149 comprises a portion of the fuel nozzle body 129 for inserting into the inner tube 121 and engaging therewith. The nozzle body 129 also includes a cavity 150 for fluid communication with the inner tube 121. It is understood that in other embodiments, the interface 149 can have a different component. For example, the inner tube 121 could fit inside cavity 150. Preferably, the inner tube interface 149 forms a tight connection with the innermost tube 121, such that fuel does not leak therebetween, and such that the fuel provided by the innermost tube 121 is directed outward through fuel conduits 151 towards the outer surface 146 of the fuel nozzle 129.

Close to the front face 153, the outer surface 146 is shaped such that it defines, together with the inner surface 141 of the primary nozzle 127, primary atomization fluid conduits 145 (or primary conduits) terminating with primary apertures 147 on the front face 153 of the fuel nozzle 129. The primary conduits 145 serve to channel the primary atomization fluid adjacent to the primary nozzle 127 towards the apertures 147. Each primary conduit 145 intersects with a corresponding fuel conduit 151 at a respective one of the primary apertures 146, thereby creating an atomized fuel mixture which is outputted through one of the primary apertures 147.

In the present embodiment, a plurality of primary apertures 147 are provided for outputting a plurality of separate streams of atomized fuel. The apertures 147 are evenly spaced and are arranged peripherally around the fuel nozzle in a circular path. As can be appreciated, in this configuration the streams of atomized fuel can be more easily controlled. Moreover, this arrangement of the apertures 147 allows for the front of the fuel nozzle 129 assembly to have many outlets instead of a single main central aperture as is the case with the prior art. In this fashion, the fuel nozzle 129 can continue to output atomized fuel even if one of the apertures is clogged. The fuel nozzle 129 has a flat front face 153 which is more easily cleaned after use. It is understood, however, that in alternate embodiments, a different number of apertures could be provided, and their arrangement could vary. In the embodiment shown, front faces of the nozzles 125, 127, 129 defining the nozzle assembly 123 are aligned.

In the illustrated embodiment, the inner surface 141 of the primary nozzle 127 is generally uniform (flat) at an interface between the primary nozzle 127 and the fuel nozzle 129. Therefore, the configuration of the conduits 145 and apertures 147 are primarily defined by the shape of the fuel nozzle 129. Advantageously, this allows for the output characteristics of the nozzle assembly 123 to be reconfigured simply by providing a new fuel nozzle 129. For example, depending on the desired operating characteristics of the burner 100, the fuel nozzle 129 can be swapped out and replaced with another fuel nozzle with a different shape and/or configuration, such as one with more or fewer apertures, with apertures of different sizes, with apertures of different angles, etc. To facilitate the replacement of the fuel nozzle 129, the front face 153 can be provided with a tool interface 155. In this illustrated embodiment, the tool interface 155 comprises a slot in which a tool can apply a torque to loosen or tighten the fuel nozzle 129 from the nozzle assembly 123. In other embodiments, other tool interfaces 155 are possible, and can include a securing mechanism, such as a bolt for example. Facilitating the removal and replacement of the fuel nozzle 129 is also advantageous, as the fuel nozzle 129 can be more easily cleaned or replaced if it is damaged.

As can be appreciated, the fuel nozzle 129 is preferably configured such that it can adequately shape and direct a flame at the output of the burner 100, while reducing or eliminating the use of cooling air. Moreover, the nozzle 129 is preferably configured to achieve an air-to-fuel ratio suitable for operation with reduced cooling air or without cooling air, while also having a high quality of atomization. The fuel nozzle 129 has several advantageous characteristics which can help attain the desired flame control and atomization quality. A first characteristic is that atomization fluid travelling through the fuel nozzle 129 is directed in a substantially longitudinally extending path from input to output. Instead of redirecting the atomization fluid inwardly to mix with the fuel, as is the case in the prior art, it is the fuel which is directed outwards in order to mix with the atomization fluid. Another characteristic is that the atomized fuel travels a short distance to exit the nozzle, for example between 2.5 mm (0.1 inches) and 12.7 mm (0.5 inches) and preferably approximately 6.4 mm (0.25 inches). The atomization air and the fuel mix directly adjacent the front face 153 of the nozzle, meaning that the air and fuel combine to form atomized fuel right before exiting the nozzle. Yet another characteristic is that the atomized fuel is divided at the output of the nozzle 129. Instead of having a single large atomized fuel stream in the center of the nozzle output, the atomized fuel is output as a plurality of evenly-spaced streams, resulting in several smaller flames which are more manageable. Similarly, the secondary air is divided at the output of the nozzle 125, allowing to control the distribution and output flow rate of secondary air.

Figure 4A:
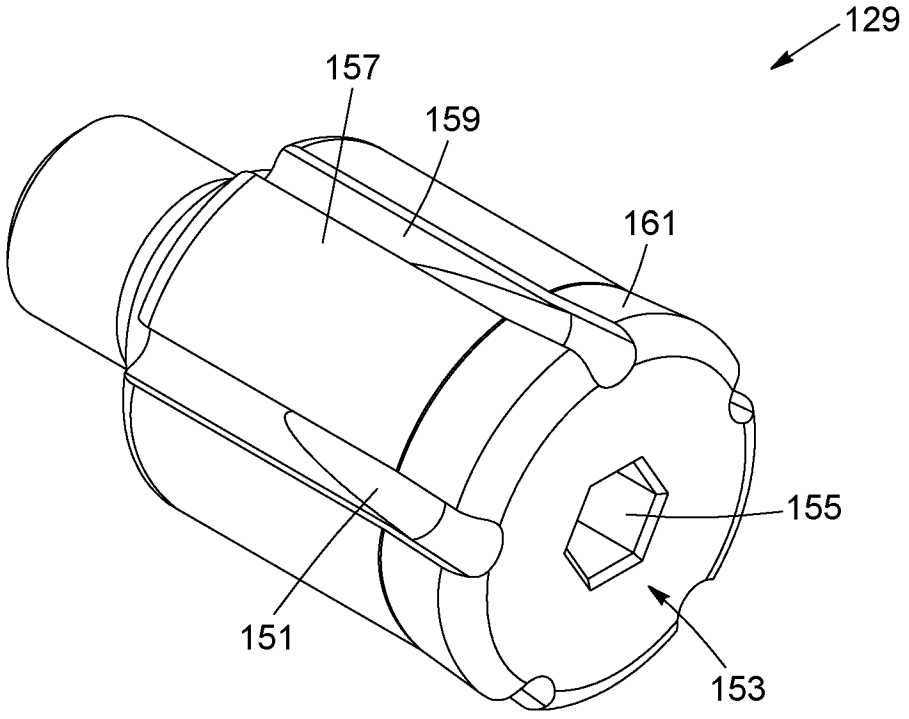
FIG. 4A is an isolated perspective view of a fuel nozzle in the nozzle assembly of FIG. 3A.
Figure 4B:
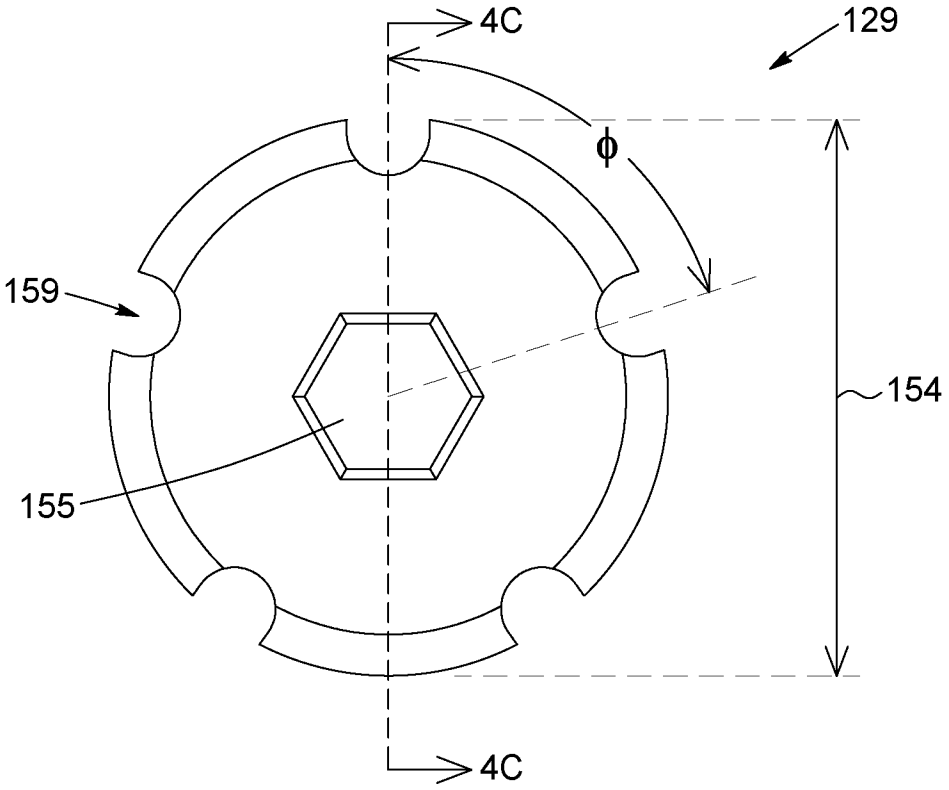
FIG. 4B is a front view of the fuel nozzle of FIG. 4A.
Figure 4C:
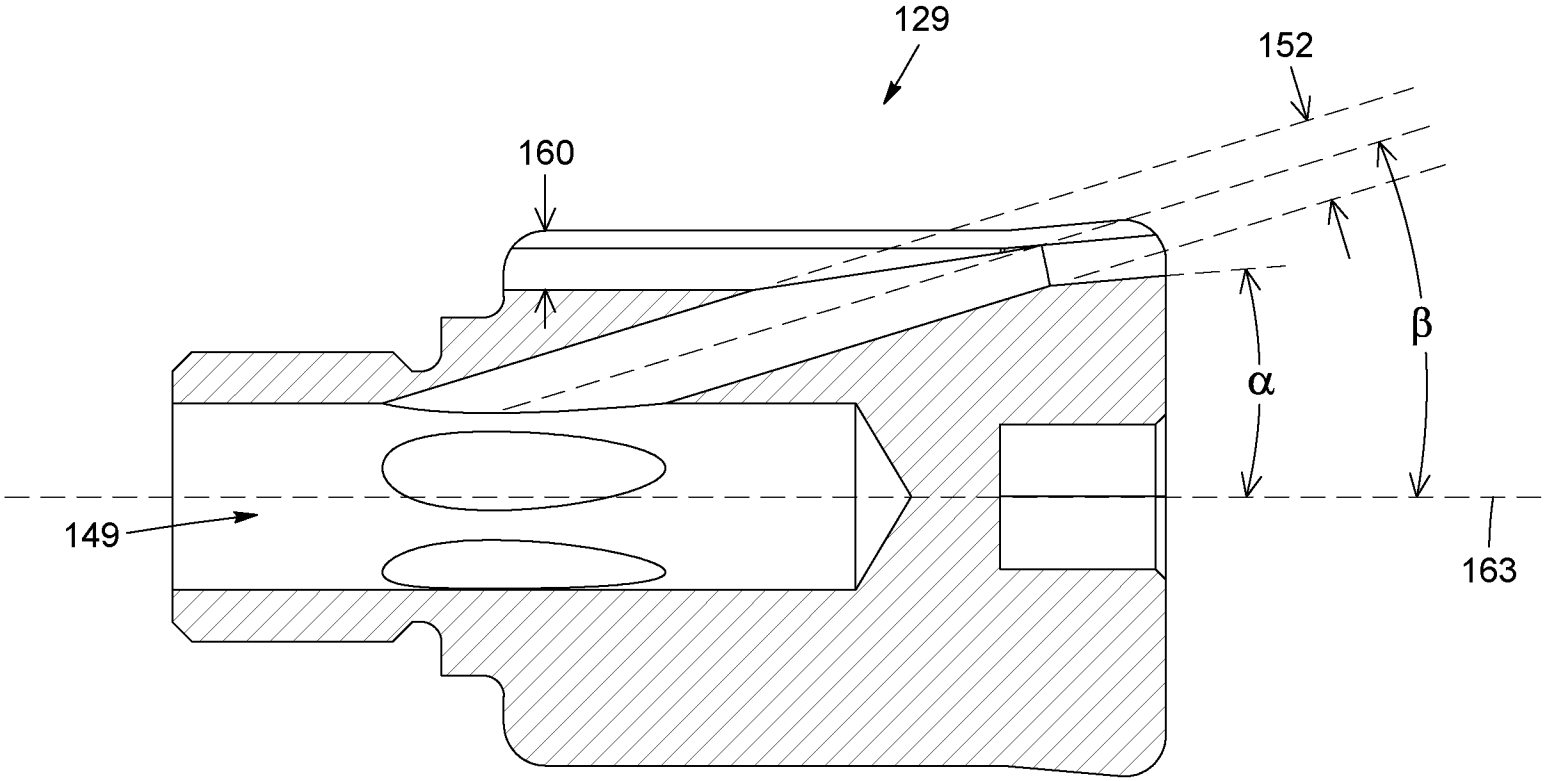
FIG. 4C is a cross-sectional view of the fuel nozzle taken along line 4C-4C of FIG. 4B.

With reference to FIGS. 4A to 4C, the fuel nozzle 129 of the present embodiment has a diameter 154 and a peripheral surface 157. In an embodiment, the diameter 154 is approximately between about 20 mm (0.8 inches) and about 23 mm (0.9 inches), but other diameters are also possible depending on the desired output characteristics of the nozzle 129. A plurality of grooves 159 extend in the peripheral edge 157 and are spaced apart from one another by an angle $\phi$. In the present embodiment, five grooves 159 are provided, each being spaced apart event by an angle $\phi$ of approximately 72 degrees. The grooves 159 define the primary conduits 145 and the primary apertures 147 when the fuel nozzle 129 is installed in the primary nozzle 127. In an embodiment, the grooves 159 have a depth 160 between about 1.3 mm (0.050 inches) and about 3.2 mm (0.125 inches), and preferably approximately 2.4 mm (0.094 inches), defining a diameter of the primary conduits 145. In an embodiment, the grooves extend substantially parallel to a central axis 163 of the nozzle 129.

Each of the grooves 159 intersects with a corresponding fuel conduit 151. The fuel conduits 151 extend through the body of the fuel nozzle 129 between the inner tube interface 149 and the grooves 159 at an angle $\beta$ relative to the central axis 163 of the nozzle 129. In an embodiment, angle $\beta$ is relatively shallow to allow for a quality atomization of the fuel at the intersection with the fuel conduit 151, and can range between approximately 15 and 20 degrees and preferably approximately 17 degrees. In an embodiment, angle $\beta$ can change gradually along the length of each fuel conduit 151 as they approach the intersection with their corresponding groove 159. In an embodiment, each one of the fuel conduits 151 has a diameter 152 between about 1.9 mm (0.075 inches) and about 25.4 mm (0.175 inches), and preferably still 3.2 mm (0.125 inches). In this configuration, the nozzle 129 can achieve quality atomization with an air-to-fuel mass ratio ($M_{air}/M_{oil}$) less than 0.25.

The fuel nozzle 129 is further provided with an angled portion 161 adjacent its face 153. The angled portion 161 allows for directing the atomized fuel exiting from the primary apertures 147, and thus allows for controlling the shape of a resulting flame. In the present embodiment, the angled portion 161 deflects the grooves 159 downstream from the intersection with fuel conduits 151 and adjacent the front face 153 by an angle $\alpha$ relative to the central axis 163 of the nozzle 129. In this fashion, atomized fuel exiting the nozzle assembly 123 via primary apertures 147 are directed at angle $\alpha$ relative to the central axis 163. In an embodiment, angle $\alpha$ is between about 2 and about 10 degrees and preferably still about 5 degrees, thereby directing atomized fuel exiting the nozzle 129 outwardly away from a central axis of the nozzle 129.

An advantage of the above-described burner 100 is that it can be operated normally without cooling air, or with greatly reduced cooling air. This is particularly useful for indurating iron ore balls into iron ore pellets in an induration furnace, such as grate kiln or a moving grate furnace, as it reduces the amount of air entering the furnace, and thus reduces the amount of air that needs to be heated to high temperatures. In doing so, less oil can be consumed when achieving desired temperatures, making the above-described burner more efficient.

It is appreciated that the above-described heavy oil burner 100 can be also used in other metallurgical gas heated furnace and, more particularly, in the iron industry characterized by high operating temperatures.

When operating the above-described heavy oil burner without cooling air, the atomization air serves two functions: it atomizes the oil while also serving to maintain the burner body at a temperature which will allow it to maintain its integrity at all times. Therefore, higher combustion temperatures, for example between 1300° C. and 1350° C. or more, require an increased flow of atomization air in order to maintain the burner body at an acceptable temperature. Meanwhile, too much atomization air can result in too much air eventually entering into the furnace. In burners of the prior art which operate with cooling air, a ratio ($M_{air}/M_{oil}$) of total air exiting the burner (atomization air+cooling air) to fuel exiting the burner is generally approximately 1.4, and usually no less than 0.8. In the present embodiment, in order to operate efficiently without cooling air, i.e. without air flowing in the secondary fluid/air line 113, the burner is operated with a total air-to-fuel ratio ($M_{air}/M_{oil}$) of less than 0.6, and preferably less than 0.5, and preferably still less than 0.25. In this case, the total air calculated for the ratio includes the atomization air and secondary air, if applicable. For example, nominal operation of the burner can include a 325 kg/hour flow of oil with a 20 kg/hour flow of atomization air, resulting in an air-to-fuel ratio of 0.06. It is appreciated that the above-described burner has a high turndown ratio, and can therefore operate over a wide range of oil and atomization air flow depending on the desired heat output.

A further advantage of the above-described burner is that secondary fluid, such as pressurized air, can be provided to maintain the burner at a nominal temperature and/or to better control the flame. Accordingly, a method for operating the above-described burner involves providing primary atomization air at a first flow rate, providing fuel, mixing the fuel with the atomization air in order to atomize the fuel, and igniting the atomized fuel in order to form a flame. In an embodiment, a ratio of the primary atomization air to the fuel is less than 0.25, and the burner is operated without the use of secondary air. Optionally, the method further involves providing secondary air at a second flow rate in order to further cool the burner and/or control the flame. The secondary air can be provided, for example, responsive to detecting a temperature of the burner above a predetermined threshold, or responsive to identifying an undesirable characteristic or shape of the flame.

In some embodiments, secondary air can be provided continuously at a relatively low flow rate in order to maintain the burner at a desired temperature during normal operation. As can be appreciated, the above-described burner is capable of operating without secondary air, so even a minimal amount of secondary air can provide additional cooling to aid in operating the burner more safely. For example, in some embodiments, the above-described burner can be operated using less than 100 kg/h of secondary air, and preferably approximately 50 kg/h of secondary air. In comparison, this can result in more than an 80% reduction relative to prior art burners which are typically operated with approximately 325-350 kg/h of secondary air.

In some embodiments, the above-described burner can operate using a ratio of atomization air mass to secondary air mass which approaches or exceeds 1, for example between 0.5 and 1.5. In other words, the burner can be operated using a comparable amount of secondary air as atomization air. For example, the burner can be operated using approximately 40 kg/h of atomization air and approximately 50 kg/h of secondary air, resulting in a ratio of about 0.8. In comparison, a prior art burner operated using 40 kg/h of atomization air can requires 325-350 kg/h of secondary air, resulting in a ratio of approximately 0.12.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A method of operating a burner assembly having an elongated body extending along a central axis between an input end and an output end, the method comprising:

providing combustible fuel at the input end of the burner assembly;

providing atomization air at the input end of the burner assembly;

providing secondary air at the input end of the burner assembly;

transporting the combustible fuel and the atomization air to the output end of the burner assembly through concentric fluid lines;

transporting the secondary air to the output end of the burner assembly in a secondary air line concentric with the combustion fuel and atomization air fluid lines;

mixing the combustible fuel and the atomization air to atomize the combustible fuel;

adjusting a flow of the combustible fuel and the atomization air to obtain atomized fuel with an air-to-fuel mass ratio of less than 0.6;

adjusting a flow of the secondary air to obtain a ratio of atomization air mass to secondary air mass of 0.5 or greater;

outputting the atomized fuel from a nozzle at the output end of the burner assembly at an angle between 2 and 20 degrees relative to the central axis of the burner assembly;

igniting the atomized fuel to produce a flame; and outputting the secondary air from the nozzle to control the flame.

2. The method according to claim 1, comprising adjusting the flow of the secondary air to achieve a secondary air output from the nozzle at a rate of less than 100 kg/h.

3. The method according to claim 1, comprising outputting the secondary air from the nozzle in a plurality of streams positioned around the flame.

4. The method according to claim 1, wherein the secondary air is provided at a consistent flow rate throughout the operation of the burner assembly, to cool the burner assembly and maintain it below a predetermined temperature.

5. The method according to claim 1, comprising measuring a temperature of the burner assembly, and varying the flow rate of the secondary air to cool the burner assembly and maintain it below the predetermined temperature.

6. The method according to claim 1, comprising outputting the atomized fuel from the nozzle in a plurality of streams positioned around the central axis of the burner assembly.

7. The method according to claim 1, comprising outputting the atomized fuel from the nozzle at an angle of approximately 5 degrees relative to the central axis of the burner assembly.

8. The method according to claim 1, wherein mixing the combustible fuel and the atomization air comprises dividing the combustible fuel into a plurality of streams, dividing the atomization air into a plurality of streams, and mixing each stream of atomization air with a respective stream of combustible fuel to produce a plurality of streams of atomized fuel.

9. The method according to claim 8, comprising directing the plurality of combustible fuel streams peripherally outward to intersect with the plurality of atomization air streams, the plurality of atomization air streams extending substantially parallel relative to the central axis of the burner assembly.

10. The method according to claim 1, wherein the combustible fuel is oil that is not gaseous at room temperature.

11. A method of heating metal-based material in an induration furnace, the method comprising providing a burner assembly, inserting the nozzle of the burner assembly into a chamber of the induration furnace, and operating the burner assembly according to the method of claim 1 to produce a flame in the induration furnace to heat the metal-based material.

12. A method of operating a burner assembly having an elongated body extending along a central axis between an input end and an output end, the method comprising:

providing combustible fuel at the input end of the burner assembly;

providing atomization air at the input end of the burner assembly;

providing secondary air at the input end of the burner assembly;

transporting the combustible fuel and the atomization air to the output end of the burner assembly through concentric fluid lines;

transporting the secondary air to the output end of the burner assembly in a secondary air line concentric with the combustion fuel and atomization air fluid lines;

mixing the combustible fuel and the atomization air to atomize the combustible fuel;

adjusting a flow of the combustible fuel and the atomization air to obtain atomized fuel with an air-to-fuel mass ratio of less than 0.6;

adjusting a flow of the secondary air to obtain a ratio of atomization air mass to secondary air mass of 0.5 or greater;

outputting the atomized fuel from a nozzle at the output end of the burner assembly in a plurality of streams positioned around the central axis of the burner assembly;

igniting the atomized fuel to produce a flame; and outputting the secondary air from the nozzle to control the flame.

* * * * *